US006430995B1

(12) United States Patent
Feller

(10) Patent No.: US 6,430,995 B1
(45) Date of Patent: Aug. 13, 2002

(54) METHOD AND DEVICE FOR ASSESSING YARN QUALITY

(75) Inventor: Peter Feller, Benglen (CH)

(73) Assignee: Zellweger Luwa AG (CH)

( * ) Notice: Subject to any disclaimer, the term of this patent is extended or adjusted under 35 U.S.C. 154(b) by 0 days.

(21) Appl. No.: 09/269,932

(22) PCT Filed: Oct. 8, 1997

(86) PCT No.: PCT/CH97/00381

§ 371 (c)(1),
(2), (4) Date: Apr. 8, 1999

(87) PCT Pub. No.: WO98/16673

PCT Pub. Date: Apr. 23, 1998

(30) Foreign Application Priority Data

Oct. 15, 1996 (CH) ..... 2514/96

(51) Int. Cl.[7] ..... B21D 1/02; B21D 7/04
(52) U.S. Cl. ..... 73/160; 73/159
(58) Field of Search ..... 73/826, 828, 160, 73/159, 552, 470; 364/552, 470

(56) References Cited

U.S. PATENT DOCUMENTS 4,758,968 A * 7/1988 Lord ..... 364/552
4,766,647 A * 8/1988 Ackermann, Jr. et al. .... 19/703
4,899,286 A * 2/1990 Colli et al. ..... 364/470

FOREIGN PATENT DOCUMENTS

| | | |
|---|---|---|
| DE | 37 32 513 | 4/1989 |
| DE | 41 24 626 | 1/1993 |
| DE | 44 11 203 | 10/1995 |
| EP | 0 282 742 | 9/1989 |
| FR | 2 090 312 | 1/1972 |

* cited by examiner

*Primary Examiner*—Max Noori
*Assistant Examiner*—Maurice Stevens
(74) *Attorney, Agent, or Firm*—Burns, Doane, Swecker & Mathis, LLP

(57) ABSTRACT

The invention relates to a method and a device for evaluating the quality of a yarn (1). In order that further aspects of the quality of a yarn may be taken into consideration and explained by measured values so that the quality of a yarn is as a whole substantially detectable, measured values relating on the one hand to the yarn exposed to friction and on the other hand to the yarn not exposed to friction are to be derived from the yarn. Both measured values are used to form a further measured value which represents a further qualitative feature.

7 Claims, 3 Drawing Sheets

METHOD AND DEVICE FOR ASSESSING YARN QUALITY

The invention relates to a method and a device for evaluating the quality of a yarn.

At present, several possible ways of evaluating the quality of a yarn are known.

A first possibility is to measure variations in the mass of the yarn over its length and to count and estimate the deviations from a mean value. For said purpose, the yarn may be scanned by an electric field or by a light beam.

A second possibility is to measure the tensile strength of a yarn using a tensile strength test. The behavior of the yarn during said tensile strength test again provides information about the quality of the yarn.

A third possibility is to measure the hairiness of the yarn, i.e. the length, number or frequency of fibers protruding from the body of the yarn.

All of the above possibilities and further possibilities not described here provide information about one or more properties of a yarn which are collectively conceived as the quality of the yarn. One of said properties, e.g. the mass variation,; relates to the appearance of the yarn or the textile fabric manufactured using said yarn. Another property, e.g. the tensile strength, relates more to the physical properties or to the behavior during further processing. A further property, e.g. the hairiness, relates more to the feel which the yarn imparts to the textile fabric when it is touched, and so on.

A drawback of the presently known methods and devices for evaluating the quality of a yarn is that they are unable to evaluate the quality as a whole. There are still aspects of the quality of a yarn which are not identified by the known methods and devices. Thus, yarns which according to certain criteria and properties have to be classified as good because they are very uniform and have a high tensile strength, for example, nevertheless cause problems during processing, e.g. during spooling, weaving etc., which limit the output of the respective processing stage.

The invention as characterized in the claims now achieves the object of providing a method and a device, with which further aspects of the quality of a yarn may be taken into consideration and explained by measured values so that the quality of a yarn as a whole is substantially detectable.

Said problem is solved in that, for evaluating the quality of a yarn, first measured values for at least one parameter of the yarn are acquired from a continuously moving yarn which is previously exposed to friction, that second measured values of the at least one parameter of the yarn are acquired from said yarn when the yarn is not previously exposed to friction and that the first and the second measured values are processed together to form third measured values which are a measure of the quality of the yarn. A device for effecting the method accordingly comprises at least one measuring head, a friction element and an evaluation unit for signals from the measuring head.

The advantages achieved thereby are that it is therefore possible to indicate a new measure of a property or quality of the yarn which is crucial for the output of the processing stages which are charged with yarn. In such processing stages yarn is, for example, drawn through elements and rubbed against elements. If the yarn stands up well to comparable loads in a test without altering substantially, then there is a high probability that it will also stand up well to further processing. This may be evaluated on the basis of measured values determined using the proposed method or the proposed device.

There follows a detailed description of an embodiment of the invention with reference to the accompanying drawings. The drawings show:

FIG. 1, a diagrammatic view of a device according to the invention,

FIGS. 2 and 3, in each case after construction of the device according to the invention, FIGS. 4 and 5, in each case a part of the device according to the invention and FIGS. 6 to 8, in each case a further construction of the part according to FIG. 4.

FIG. 1 shows a device, in which yarn 1 is moved in the direction of the arrow in a manner known per se and therefore not described in detail here. Disposed along the yarn 1 are: a first measuring head 2, a friction element 3, a second measuring head 4 and a speed measuring device 5. The measuring heads 2 and 4 are each connected by a line or a bus 6, 7 to an evaluation unit 8, 9. The latter are in turn connected by lines 10, 11 or a bus to a signal processing unit 12, which has an output 13. The speed measuring device 5 is likewise connected by a line 14 to the unit 12. It is however quite possible to integrate the evaluation units 8 and 9 into the measuring heads 2 and 4. The same applies to the speed measuring device 5. It is however easier, in the present somewhat more sharply detailed arrangement, to explain the functions of the elements. The measuring heads 2, 4 with the evaluation units 8, 9 are known elements which are familiar from commercially available yarn testing appliances. The appliances known by the name of USTER TESTER or slub catchers manufactured by Zellweger Uster are cited as examples of such yarn testing appliances. The signal processing unit 12 may, for example, take the form of a computer which has a program for processing the measured values from the lines 10 and 11. The speed measuring device 5 is an element of the type which is likewise known from textile machine construction.

FIG. 2 shows another device having a measuring head 15 for a first yarn 16 and a second measuring head 17 for a second yarn 18. A friction element 19 is disposed in front of the measuring head 17 only. Both measuring heads 15, 17 are again connected by lines 6, 7 to evaluation units 8, 9. Lines 10, 11 connect said evaluation units to a signal processing unit 12.

FIG. 3 shows a further device having a measuring head 20 and a friction element 21, an evaluation unit 22 and a unit 23 for processing measured values. Here, the friction element 21 is connected by a line 24 to the unit 23.

Figure 7:
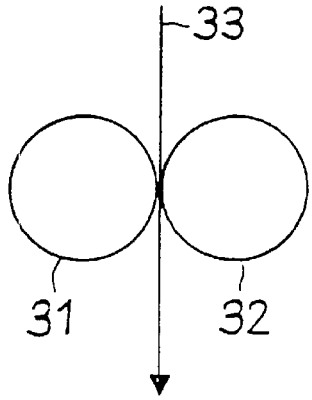
Figure 6:
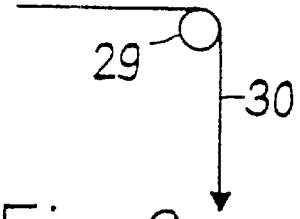
FIG. 6 shows, as a friction device, a stationary pin 29 around which the yarn 30 is only partially wrapped.

FIG. 7 shows, as a friction element, two rollers 31, 32, which clamp the yarn 33 and are disposed in a stationary manner or so as to move only partially, against resistance, with the yarn 33.

Figure 8:
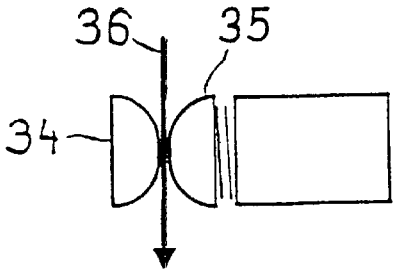

FIG. 8 shows, as a friction element, two jaws 34, 35 which clamp the yarn 36. One of the jaws 35 is supported by means of a spring and exerts a pressure force upon the yarn 36 and the jaw 34. Thus, the friction elements from FIGS. 7 and 8 are designed with an adjustable or controllable action.

Figure 1:
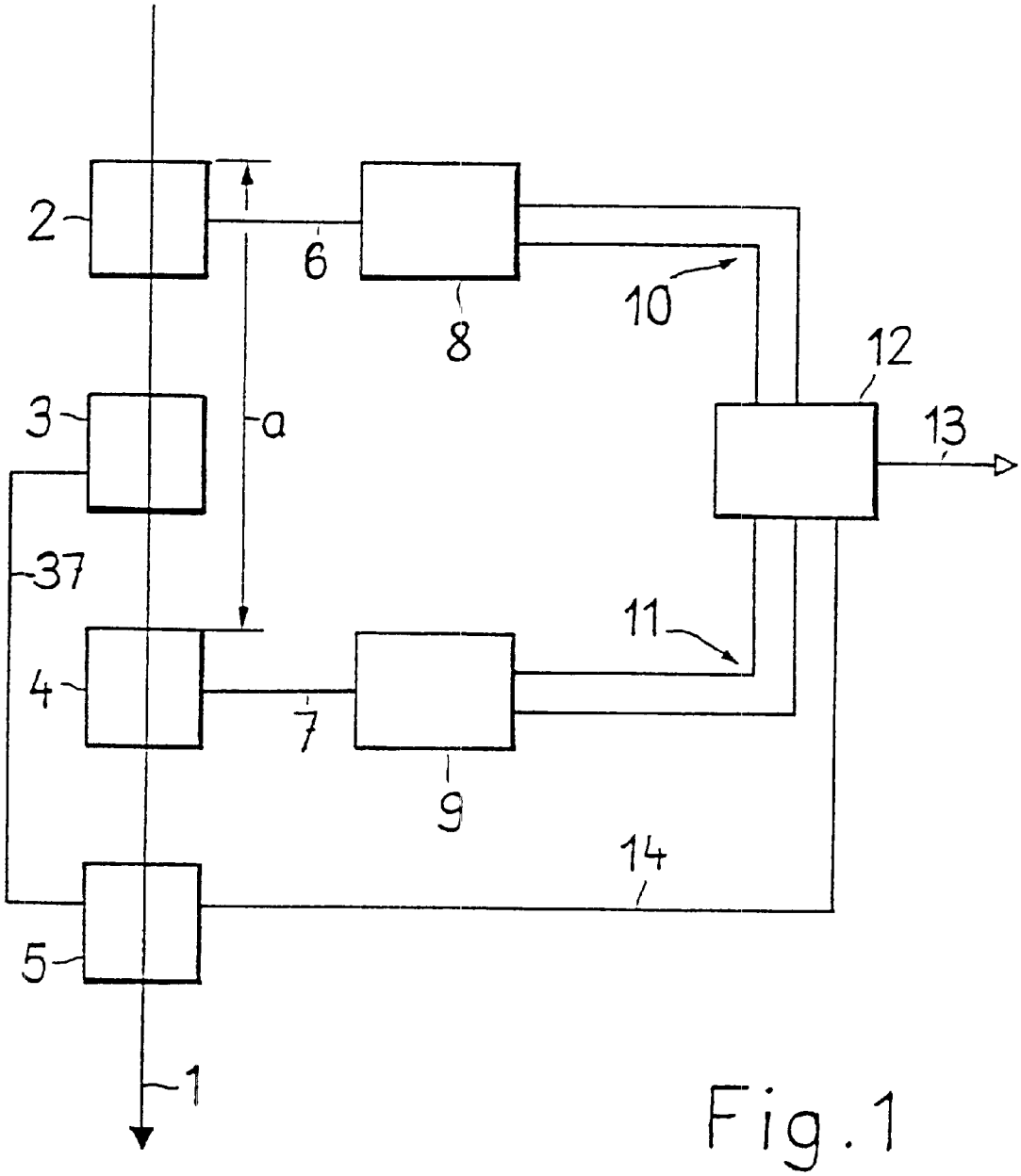

The mode of operation is as follows: while the yarn 1 (FIG. 1) is moving in its longitudinal direction, the measuring head 2 measures second measured values for a parameter of the yarn 1 which is not exposed to particular friction. In the friction element 3 the yarn 1 is exposed to friction and the measuring head 4 measures first measured values for the parameter after the yarn 1 has been exposed to friction. In the evaluation units 8, 9 the first and the second measured values are subjected to a first evaluation, which may, for example, mean that a mean value of the parameter is calculated and output together with the actual measured value or that only a differential value relative to the mean value is output. Such values are supplied via the lines 10, 11 to the unit 12, which generates a derived signal or third measured values from the measured values supplied by the evaluation units 8 and 9. These are output via the output 13. Since the two measuring heads 2 and 4 lie spatially apart from one another, the unit 12 may, on the basis of the fixed distance a and the actual speed of the yarn 1 as communicated via the line 14, offset the signals against one another in such a way that the signals from the lines 10 and 11 may be assigned in each case to a specific yarn portion.

Figure 2:
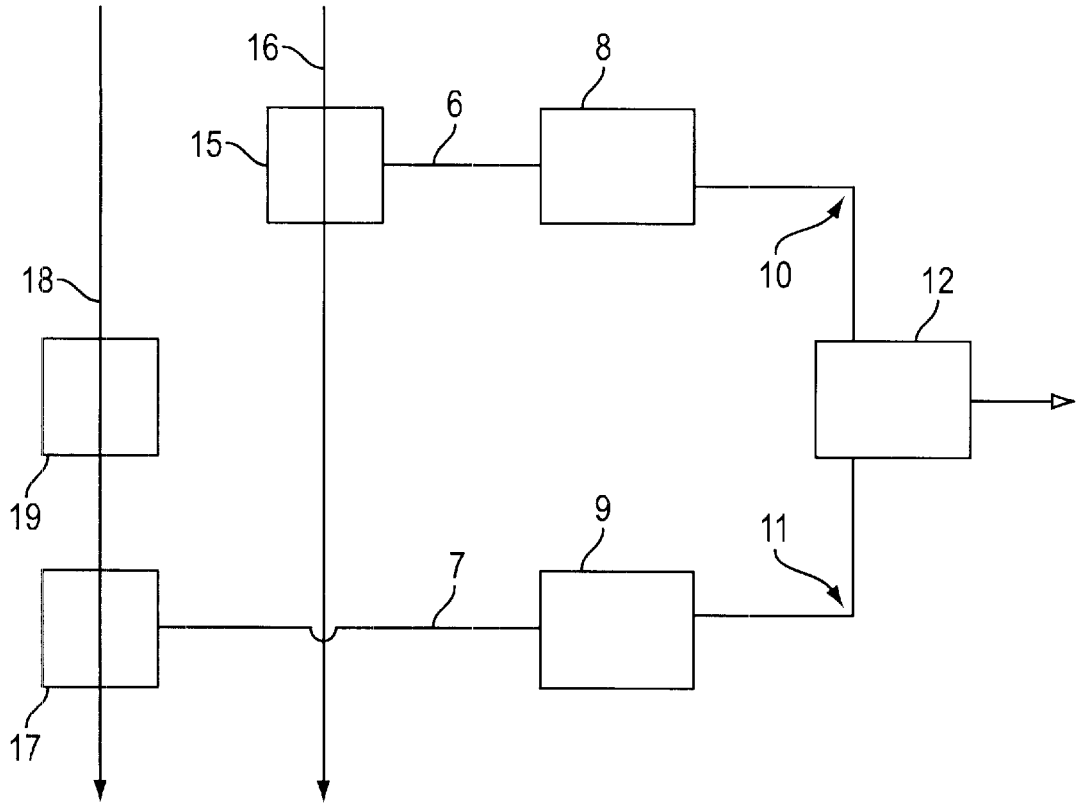

With the device according to FIG. 2, the two measurements are carried out no longer in series on the same piece of yarn but in parallel. Thus, a yarn 16 may be fed first to the measuring head 15 and then to the measuring head 17, or yarn 16 may be a reference yarn, while yarn 18 is a yarn which is actually to be measured.

Figure 3:
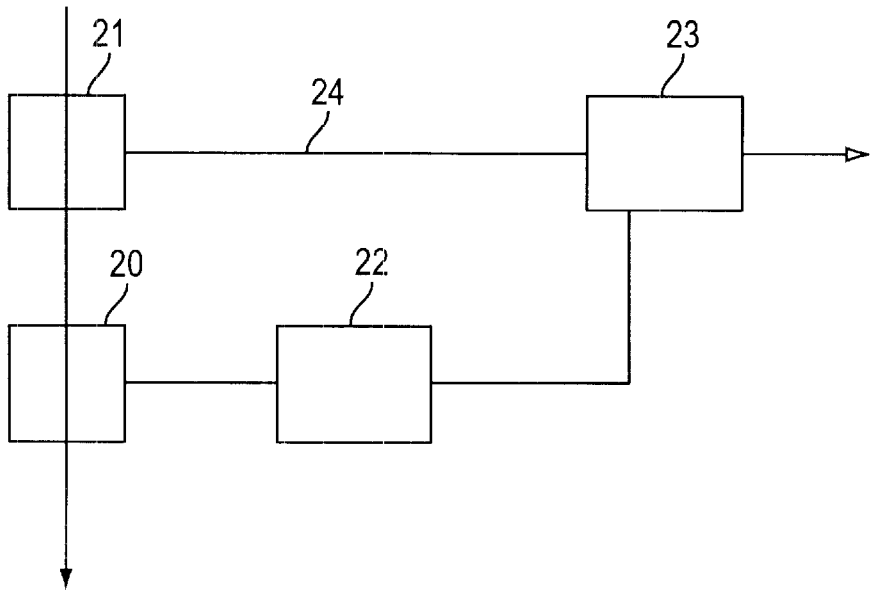
Figure 4:
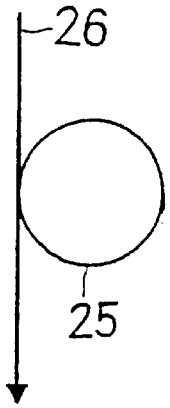
FIG. 4 shows a diagrammatic, simplified view of a friction element in the form of a stationary drum 25, around which the yarn 26 is wrapped. The drum preferably has a surface made of a non-textile material.

With the device according to FIG. 3, the yarn may be measured with the friction element 21 periodically switched on and off. Thus, first measured values are measured with the friction element 21 switched on and second measured values with the friction element 21 switched off. Via line 24 the unit 23 is informed when the friction element is switched off and when it is switched on, or the friction element may even be activated by the unit 23. The unit 23 then offsets the measured values from successive yarn portions against one another to form third measured values which indicate the quality of the yarn.

Figure 5:
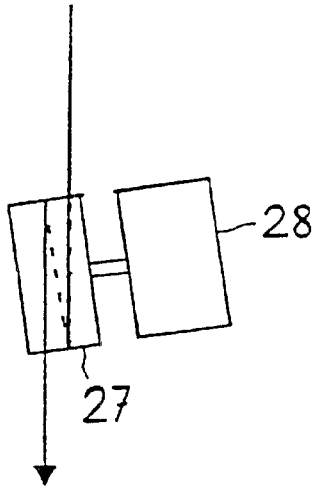
FIG. 5 shows a rotatable drum 27, which is mechanically connected by an axis of rotation to a braking device 28.

The friction generated at the friction elements results in the yarn altering to a greater or lesser extent. Said alteration is expressed in third measured values which are output by the unit 23. The friction may also be kept more or less independent of the actual speed of the yarn, this being achievable with a friction element according to FIG. 5 or 7 particularly when the drums 27 or rollers 31, 32 may be braked controllably in dependence upon the yarn speed. To said end, in FIG. 1 the friction element 3 may also be connected by a line 37 to the speed measuring device 5.

Certain yarns have an unstable surface structure. They are hairy and the hairs are not firmly anchored in the surface. In the event of friction or deflection, the hairs at the friction point are pushed upwards and lead to localized thickened portions, which have the character of neps and are also classified as such by yarn testing appliances like the USTER TESTER. To measure genuine neps, it is therefore necessary to keep the friction and the number of deflections to a minimum. However, this means that sensitive yarns are evaluated too positively because the next processing step produces further neps.

As parameters measurable at the yarn, the number of neps per length of yarn or the number of diameter deviations which exceed a set amount are preferably suitable. For said reason, the speed measuring device 5 is preferably designed in such a way that it may also supply the unit 12 with a signal which indicates the detected yarn length.

Reproduced below, as examples, are first, second and third measured values for four parameters—mass variation, number of thick and thin places, number of neps and hairiness which originate in each case from ten measurements of ten different portions of a yarn which has proved to have a very sensitive response to friction.

EXAMPLE 1

For the short-wave mass variation in percent, by (%) from a mean value, the following measured values were measured:

| 1st measured values | 2nd measured values | 3rd measured values |
|---|---|---|
| 8.48 | 7.8 | 0.68 |
| 8.29 | 7.61 | 0.68 |
| 8.4 | 7.55 | 0.85 |
| 8.41 | 7.7 | 0.71 |
| 8.46 | 7.58 | 0.88 |
| 8.42 | 7.52 | 0.9 |
| 8.44 | 7.41 | 1.03 |
| 8.38 | 7.3 | 1.08 |
| 8.28 | 6.8 | 1.48 |
| 8.34 | 6.93 | 1.41 |
| mean: | | |
| 8.39 | 7.42 | 0.97 |

EXAMPLE 2

For the number of thin places deviating by at least −30% from the mean value of the yarn diameter and for the number of thick places exceeding the mean value by at least +35%, the following values were measured on the same yarn:

| 1st measured values | | 2nd measured values | | 3rd measured values | |
|---|---|---|---|---|---|
| thin | thick | thin | thick | thin | thick |
| 76 | 60 | 31 | 11 | 45 | 49 |
| 58 | 63 | 29 | 7 | 29 | 56 |
| 53 | 59 | 36 | 13 | 17 | 46 |
| 73 | 53 | 29 | 3 | 44 | 50 |
| 61 | 54 | 32 | 9 | 29 | 45 |
| 71 | 58 | 19 | 8 | 52 | 50 |
| 59 | 74 | 23 | 5 | 36 | 69 |
| 61 | 67 | 15 | 7 | 46 | 60 |
| 46 | 55 | 7 | 3 | 39 | 52 |
| 57 | 50 | 11 | 1 | 46 | 49 |
| mean values: | | | | | |
| 154/km | | 58/km | | 96/km | |
| 148/km | | 17/km | | 131/km | |

EXAMPLE 3

For the number of neps exceeding the mean diameter of the yarn by at least +140%, the following measured values arise:

| 1st measured values | 2nd measured values | 3rd measured values |
|---|---|---|
| 187 | 9 | 178 |
| 209 | 4 | 205 |
| 230 | 7 | 223 |
| 222 | 1 | 221 |
| 214 | 8 | 206 |
| 202 | 2 | 200 |
| 196 | 2 | 194 |
| 218 | 7 | 211 |
| 215 | 5 | 210 |
| 189 | 1 | 188 |
| mean: | | |
| 520/km | 12/km | 508/km |

For the hairiness, the following measured values arise:

| 1st measured values | 2nd measured values | 3rd measured values |
|---|---|---|
| 4.43 | 4.18 | 0.25 |
| 4.38 | 4.18 | 0.2 |
| 4.37 | 4.14 | 0.23 |
| 4.39 | 4.16 | 0.23 |
| 4.42 | 4.14 | 0.28 |
| 4.44 | 4.15 | 0.29 |
| 4.43 | 4.1 | 0.33 |
| 4.38 | 4.06 | 0.32 |
| 4.34 | 4.02 | 0.32 |
| 4.34 | 4.0 | 0.34 |
| mean: | | |
| 4.39 | 4.11 | 0.28 |

As is evident from said examples, the third measured values obtained by subtracting the second measured values from the first measured values reveal that deviations exist between the second measured values, i.e. values measured on the yarn without friction, and first measured values, i.e. values measured on the yarn with the influence of friction, and provide an indication of the quality of the yarn. Similar results are obtained when such measurements are carried out with other parameters not mentioned here.

What is claimed is:

1. Method of evaluating the quality of a yarn, comprising the steps of acquiring from a continuously moving yarn which previously has been exposed to friction one set of measured values for at least one parameter of the yarn, acquiring another set of values of the at least one parameter of the yarn when the yarn has not been exposed to friction, and processing said sets of values together to provide different values which are a measure of the quality of the yarn.

2. Method according to claim 1, further characterized by acquiring said sets of values in series from the same piece of yarn.

3. Method according to claim 1, further characterized by acquiring said sets of values in different test lines through which portions of the yarn pass.

4. Method according to claim 1, wherein the number of short-wave mass deviations are acquired as measured values.

5. Method according to claim 1, including rubbing the yarn against a friction element made of non-textile material to expose the yarn to friction.

6. A method for deriving measured values indicative of an aspect of yarn quality, comprising moving a yarn lengthwise through an elongated path, rubbing the moving yarn against a non textile friction surface located adjacent a first portion of said path to generate friction, sensing a particular yarn parameter as the yarn moves past a second portion of said path upstream of said first portion to produce a second set of measurement values not affected by the rubbing of the yarn against the friction surface, sensing the same particular yarn parameter as the yarn moves past a third portion of said path downstream of said first portion to produce a first set of measurement values with respect to the yarn after it has been rubbed against said surface to generate friction, and processing said first and second sets of measurement values and combining the results to produce numbers indicative of the effect of the rubbing action on the particular yarn parameter.

7. Apparatus for obtaining a measure of yarn quality with respect to a yarn moving lengthwise through an elongated path, said apparatus comprising:

a friction element disposed adjacent a first portion of said path in position to cause said yarn to rub against said friction element as the yarn moves lengthwise through said path;

a first measuring head disposed adjacent a portion of said yarn path upstream of said friction element for sensing a particular yarn parameter as the yarn moves past said first measuring head to produce a set of measurement values not affected by the rubbing of the yarn against said friction element;

a second measuring head disposed adjacent a portion of said yarn path downstream of said friction element for sensing said particular yarn parameter as the yarn moves past said second measuring head to produce an additional set of measurement values with respect to the yarn after it has been rubbed against said friction element; and processor means operatively connected to said first and second measuring heads for producing values based upon both of said sets of measurement values.

* * * * *